US007101187B1

(12) United States Patent
Deconinck et al.

(10) Patent No.: US 7,101,187 B1
(45) Date of Patent: Sep. 5, 2006

(54) ROTATABLE ELECTRICAL CONNECTOR

(75) Inventors: Joseph F. Deconinck, West Babylon, NY (US); William J. Azzoli, Howard Beach, NY (US)

(73) Assignee: Protex International Corp., Bohemia, NY (US)

( * ) Notice: Subject to any disclaimer, the term of this patent is extended or adjusted under 35 U.S.C. 154(b) by 0 days.

(21) Appl. No.: 11/201,898

(22) Filed: Aug. 11, 2005

(51) Int. Cl.
*H01R 39/00* (2006.01)

(52) U.S. Cl. ..... 439/22; 439/66

(58) Field of Classification Search ..... 439/15–21, 439/22, 24, 66, 67
See application file for complete search history.

(56) References Cited

U.S. PATENT DOCUMENTS

| | | | | |
|---|---|---|---|---|
| 1,098,501 | A | 6/1914 | Holdaway et al. | |
| 1,174,379 | A | 3/1916 | Bacon | |
| 1,222,376 | A | 4/1917 | Ferguson | |
| 1,288,511 | A | 12/1918 | Clarke | |
| 2,134,355 | A | 10/1938 | Caldwell | |
| 2,288,259 | A | 6/1942 | Gladulich | |
| 2,721,822 | A | 10/1955 | Pritikin | |
| 2,898,572 | A | 8/1959 | Shinn | |
| 3,479,632 | A | 11/1969 | Galles | |
| 3,808,382 | A | 4/1974 | Blanch et al. | |
| 4,026,618 | A * | 5/1977 | Straka | 439/21 |
| 4,061,381 | A | 12/1977 | Smal | |
| 4,472,010 | A | 9/1984 | Parnello | |
| 4,533,796 | A | 8/1985 | Engelmore | |
| 4,583,798 | A | 4/1986 | Blazowich | |
| 4,590,337 | A | 5/1986 | Engelmore | |
| 4,673,228 | A | 6/1987 | Ditzig | |
| 4,699,591 | A | 10/1987 | Gallo et al. | |
| 4,764,121 | A | 8/1988 | Ditzig | |
| 4,932,882 | A | 6/1990 | Kang | |
| 5,082,448 | A * | 1/1992 | Kang | 439/22 |
| 5,124,685 | A | 6/1992 | Rankin | |
| 5,146,205 | A | 9/1992 | Keifer et al. | |
| 5,552,771 | A | 9/1996 | Leyden et al. | |
| 5,723,815 | A | 3/1998 | Pena | |
| 6,039,496 | A | 3/2000 | Bishop | |
| 6,132,219 | A * | 10/2000 | Sobhani et al. | 439/17 |
| 6,299,454 | B1 * | 10/2001 | Henderson et al. | 439/19 |
| 6,896,543 | B1 | 5/2005 | Fort et al. | |
| 6,946,961 | B1 | 9/2005 | Frederiksen et al. | |

OTHER PUBLICATIONS

BGB Engineering—Moving Technology, web site: http:/www.bgbengineering.com:—1 page (visited Mar. 16, 2005).

The Sibley Company web site: http:/www.sibley.com:- Electrical Slip Rings—Sibley—1 page (visitedMar. 16, 2005).

Meridian Labs web site: http:/www.meridianlab.com:—Rotocon high performance rotary electrical contacts—3 pages (visited Mar. 16, 2005).

Web Site: http:/www.airflyteelectronics.com/Sirflyte/Home—Slip Ring Assemblies—Airflyte Electronics . . . What Is A Slip Ring?—1 page (visited Mar. 16, 2005).

* cited by examiner

*Primary Examiner*—James R. Harvey
(74) *Attorney, Agent, or Firm*—Collard & Roe, P.C.

(57) ABSTRACT

A rotatable electrical connector provides a tangle free electrical connection between a cable modular male plug and a modular female jack of a device. The connector includes a male subassembly with a modular plug secured to a printed circuit board. A female subassembly includes a modular jack secured to another printed circuit board. At least one multi-pin block is secured to one of the printed circuit boards. The multi-pin block has a plurality of resilient electrically conducting elements which contact traces on each of the printed circuit boards. An axle rotatably connects the male and female subassemblies which may be enclosed in a housing.

50 Claims, 6 Drawing Sheets

ROTATABLE ELECTRICAL CONNECTOR

BACKGROUND OF THE INVENTION

1. Field of the Invention

This invention relates to a rotatable electrical connector. In particular, the invention relates to a rotatable electrical connector which provides an electrical connection between a cable having a modular male plug and a device having a modular female jack so as to avoid tangling of the cable. The invention further relates to rotatable electrical connectors for providing an electrical connection between a plurality of modular male plugs or a plurality of female jacks.

2. The Prior Art

Rotatable electrical connector devices are known. For example, U.S. Pat. Nos. 5,082,448 and 4,932,882 to Kang; U.S. Pat. No. 1,098,501 to Holdaway et al.; U.S. Pat. No. 1,174,379 to Bacon; U.S. Pat. No. 2,288,259 to Gladulich; U.S. Pat. No. 4,472,010 to Parnello; U.S. Pat. No. 4,533,796 and U.S. Pat. No. 4,590,337 to Engelmore; U.S. Pat. No. 4,583,798 to Blazowich; U.S. Pat. No. 4,699,591 to Gallo et al.; and U.S. Pat. Nos. 4,673,228 and 4,764,121 to Ditzig relate to rotatable connectors for use with telephone handsets and the like.

Additionally, U.S. Pat. No. 4,061,381 to Smal relates to a twist prevention device for the electrical connection of appliances such as curling tongs, electric shavers and the like. U.S. Pat. No. 2,134,355 to Caldwell and U.S. Pat. No. 2,898,572 to Shinn relate to swivelling electrical connectors for connection to a wall outlet or socket. U.S. Pat. No. 3,479,632 to Galles relates to a rotatable support table having slip ring conductors for providing power to a business machine supported on the table as it is rotated. U.S. Pat. No. 2,721,822 to Pritkin relates to a method for producing printed circuits with crossover connections.

SUMMARY OF THE INVENTION

The invention relates to a rotatable electrical connector for providing a tangle free connection between a cable having a modular male plug and a device having a modular female jack.

A male subassembly comprises a modular plug which includes a plurality of electrically conducting members disposed in an electrically insulating member. Each of the electrically conducting members may have a first terminal end for contacting a modular female jack of a device and a second terminal end.

The male subassembly also includes a printed circuit board having a plurality of conductive pads on a first surface facing the modular surface mount plug and a plurality of concentric circular conductive traces disposed on a second surface. Each of the concentric circular conductive traces is in electrical communication with a corresponding one of the conductive pads.

The modular plug is secured to the first surface of the printed circuit board, preferably in a substantially perpendicular orientation. The second terminal end of the plurality of electrical conducting members is in electrical communication with corresponding conductive pads on the printed circuit board.

A female subassembly comprises a modular jack which includes a plurality of electrically conducting members disposed in an electrically insulating member. Each of the electrically conducting members may have a first terminal end for contacting a modular male plug of a cable and a second terminal end.

The female subassembly includes a printed circuit board having a plurality of conductive pads on a first surface facing the modular jack and a plurality of conductive pads disposed on a second surface. Each of the conductive pads on the first surface of the printed circuit board is in electrical communication with a corresponding one of the conductive pads on the second surface of the printed circuit board.

The female subassembly may also include at least one multi-pin block which is secured to the second surface of the printed circuit board. The multi-pin block has a plurality of resilient, electrically conducting elements, each of which is in electrical communication with a corresponding concentric circular conductive trace of the first printed circuit board and a with a corresponding conductive pad on the second printed circuit board.

The modular jack is secured to the first surface of the printed circuit board, preferably in a substantially perpendicular orientation. The second terminal end of the plurality of electrical conducting members of the modular jack is in electrical communication with corresponding conductive pads on the printed circuit board.

An axle extends substantially perpendicularly to the printed circuit boards and rotatably connects the male and female subassemblies. In an embodiment according to the invention, an axle may extend from a base portion of the electrically insulating member of the modular plug. One or more of the printed circuit boards may have a through hole through which at least a portion of the axle extends.

One or more of the modular plug, modular jack and/or multi pin block may comprise surface mount components.

A housing may enclose the male and female subassemblies and a retainer may retain the male and female subassemblies in the housing. The housing may include an aperture through which an elongated tool may be inserted for releasing a modular plug.

At least one of the printed circuit boards may include a counterbore for receiving and/or engaging the axle. The counterbore may be formed by drilling or otherwise machining the printed circuit board or by constructing the printed circuit board from a plurality of layers. At least a portion of the counterbore may be coated to reduce friction between the printed circuit board and the axle.

A rotatable electrical connector according to another embodiment of the invention includes a modular jack secured to a printed circuit board which has a plurality of conductive pads disposed on a first surface facing the modular jack and a plurality of concentric circular traces on a second surface and in electrical communication with the corresponding pads. A modular plug is secured to a second printed circuit board having a first plurality of conductive pads on one side and a second plurality of conductive pads on a second side.

A rotatable electrical connector according to another embodiment of the invention includes a first subassembly with a first modular plug secured to a first circuit board. The first circuit board has a plurality of conductive pads on a first surface facing the first modular plug and a plurality of concentric circular traces on a second surface. Each circular trace is in electrical communication with a corresponding pad on an opposite side of the printed circuit board.

A second subassembly has a second modular plug secured to a second printed circuit board. The second printed circuit board has a first plurality of conductive pads on a first surface facing the second modular plug and a second plurality of conductive pads on a second surface. Each of conductive pads on the first surface of the second printed circuit board is in electrical communication with a corresponding conductive pad on the second surface of the second printed circuit board.

One or more multi pin blocks are secured to the second surface of the second printed circuit board. Each of the one or more multi pin blocks has a plurality of resilient electrically conducting elements in electrical communication with a corresponding pad on the second surface of the second printed circuit board and a corresponding concentric circular trace on the second surface of the first printed circuit board.

A rotatable electrical connector according to another embodiment of the invention includes a first subassembly with a first modular jack secured to a first circuit board. The first circuit board has a plurality of conductive pads on a first surface facing the first modular jack and a plurality of concentric circular traces on a second surface. Each circular trace is in electrical communication with a corresponding pad on an opposite side of the printed circuit board.

A second subassembly has a second modular jack secured to a second printed circuit board. The second printed circuit board has a first plurality of conductive pads on a first surface facing the second modular jack and a second plurality of conductive pads on a second surface. Each of the conductive pads on the first surface of the second printed circuit board is in electrical communication with a corresponding conductive pad on the second surface of the second printed circuit board.

One or more multi pin blocks are secured to the second surface of the second printed circuit board. Each of the one or more multi pin blocks has a plurality of resilient electrically conducting elements in electrical communication with a corresponding pad on the second surface of the second printed circuit board and a corresponding concentric circular trace on the second surface of the first printed circuit board.

An advantage of a rotatable electrical connector according to an embodiment of the invention is that a multi-conductor connection is provided wherein both power and signal currents may be transmitted via said connection.

Another advantage of a rotatable electrical connector according to an embodiment of the invention is that a connector may be provided which uses surface mount components, thereby achieving a rotatable connector which is compact in size and simple and inexpensive to manufacture.

Another advantage of a rotatable electrical connector according to an embodiment of the invention is that a rotatable electrical connector may be configured for providing a tangle free electrical connection between a modular male plug and a modular female jack, between a modular male plug and another modular male plug and/or between a modular female connector and another modular female connector.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
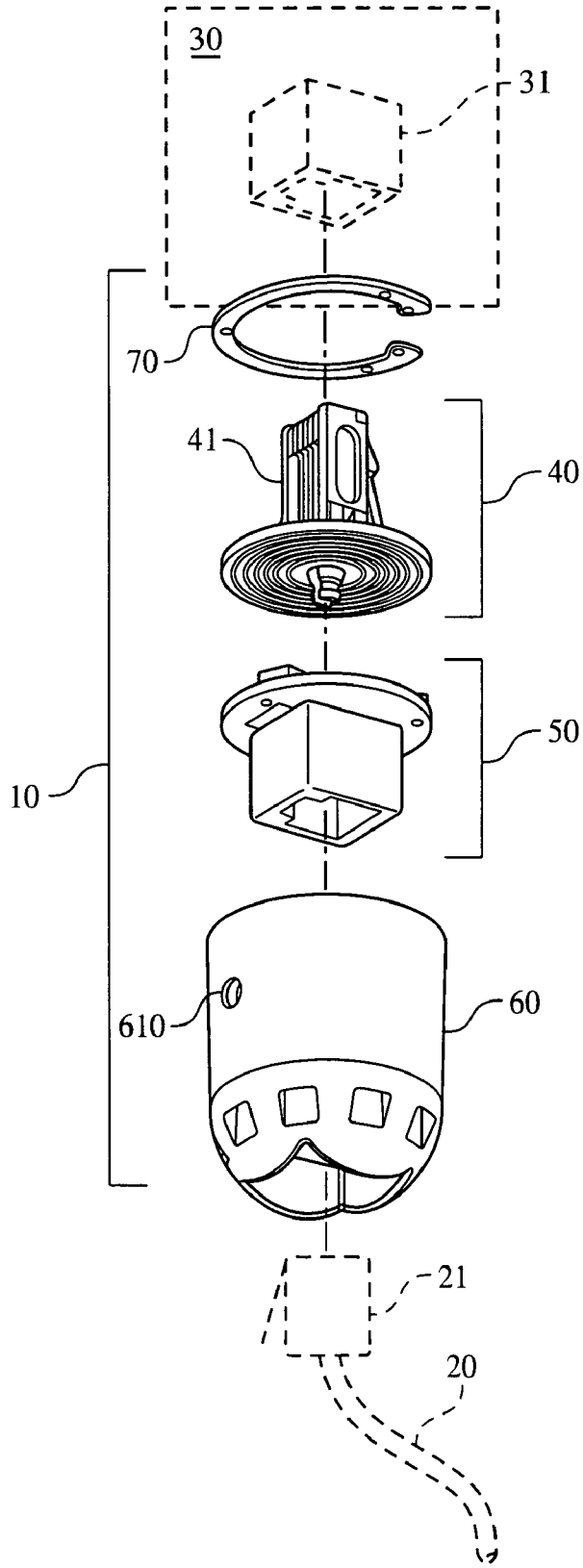
FIG. 1 shows an exploded perspective view of a rotatable electrical connector according to an embodiment of the invention.

Referring now in detail to the drawings and, in particular, FIG. 1 shows an exploded perspective view of a rotatable electrical connector 10 according to an embodiment of the invention. As shown rotatable electrical connector 10 may provide a tangle free connection between a cable 20 having a modular male plug 21 and a device 30 having a modular female jack 31. For example, in use, rotatable electrical connector 10 may be employed to provide a tangle-free connection between a telephone handset and a cable connecting the handset to a base, between a housing of a security system for displaying a handheld electronic device and a retractable cable coupled to the housing, or between any other cable and device wherein a tangle free electrical connection is desirable.

Figure 2:
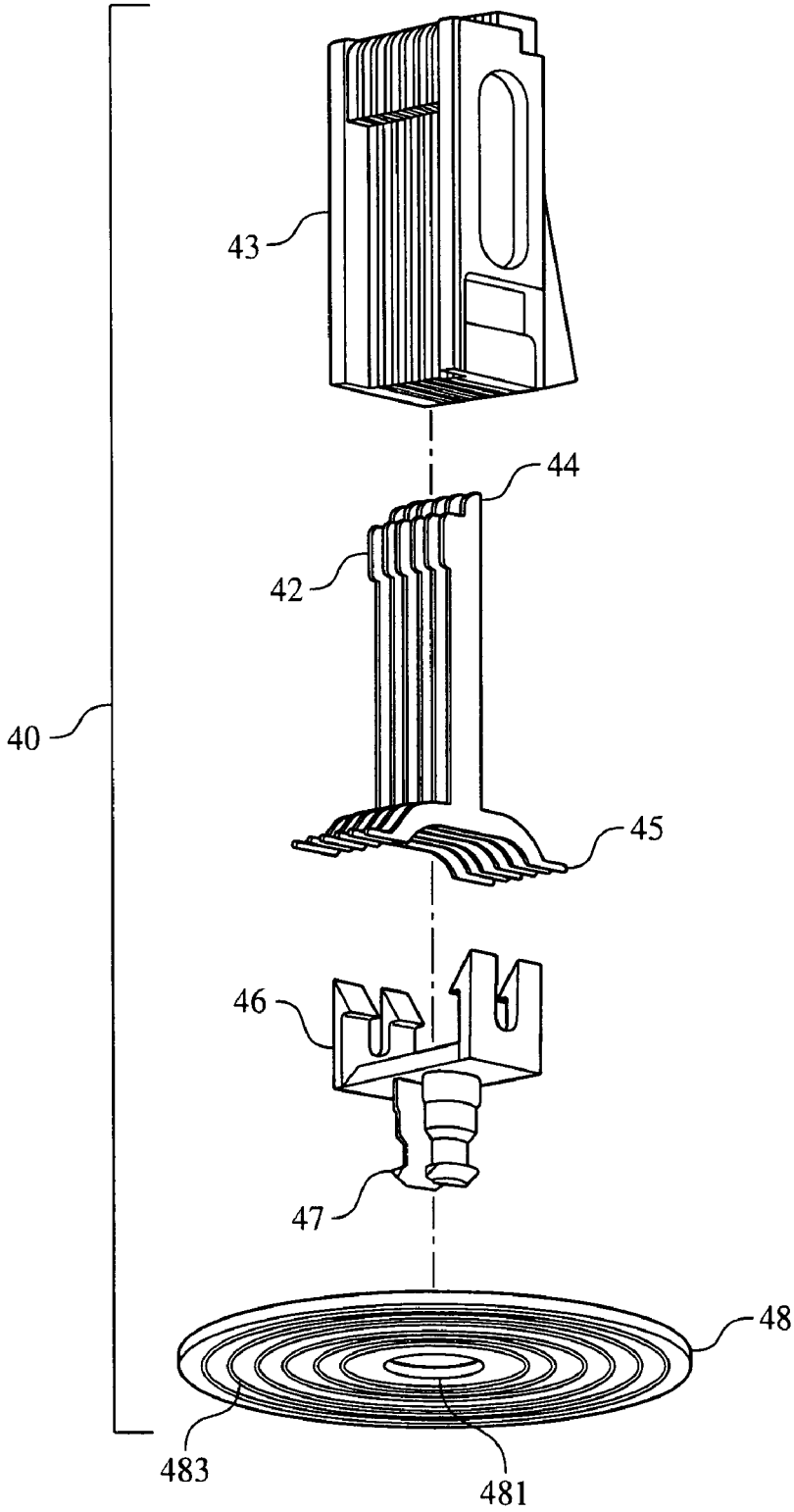
FIG. 2 shows an exploded view of a male subassembly for a rotatable electrical connector according to an embodiment of the invention.

Rotatable electrical connector 10 may comprise a male subassembly 40 and a female subassembly 50. The male subassembly 40 includes a modular plug 41. As shown in FIG. 2, the modular plug 41 may comprise a plurality of electrically conducting members 42 which are disposed in an electrically insulating member 42.

Electrically conducting members 42 may comprise, for example, a plurality of die cut pins formed from copper or any other suitable electrically conductive material. Electrically insulating member 43 may be formed from a plastic or any other suitable electrically insulating material and may include discrete grooves or channels as shown to separate individual electrically conducting members 42. Electrically insulating member 43 may further include a lever portion for engaging an associated receiving means in device modular female jack 31.

Each of the electrically conducting members 42 in modular plug 41 may have a first terminal end 44 for contacting an associated conductor element in device modular female jack 31. Each of the electrically conducting members 42 in modular plug 41 may further have a second terminal end 45.

Male subassembly 40 may further comprise a base portion 46. As shown, base portion 46 may comprise a U-shaped, electrically insulating member. Base portion 46 may include tabs or hook-like protrusions which engage a lower portion of electrically insulating member 43 and allow base portion 46 to snap into place. Base portion 46 may be secured to electrically insulating member 43 via these tabs or protrusions, if present and/or alternatively may be secured to electrically insulating member 43 with an adhesive or other suitable fastening means. Base portion 46 may serve to retain electrically conducting members 42 in place.

An axle or shaft 47 may be provided for rotatably coupling male subassembly 40 to female subassembly 50. Axle 47 may be formed integrally with base portion 46 as shown, or alternatively may be a separate component. Axle 47 may comprise, for example, a split structure of varying diameter which is adapted for insertion through and engagement with a through hole 481 and/or counterbore 581 provided in a printed circuit board 48, 58.

Male subassembly 40 may further include a printed circuit board 48. Printed circuit board 48 may be circular in shape and may in include a through hole 481 disposed at a substantially central portion thereof, wherein at least a portion of axle 47 may extend through through hole 481.

Printed circuit board 48 may be formed by conventional techniques for manufacturing such components and may comprise multiple layers of electrically insulating material provided with traces of electrically conductive material selectively forming an electrically conducting circuit in the printed circuit board.

Figure 4:
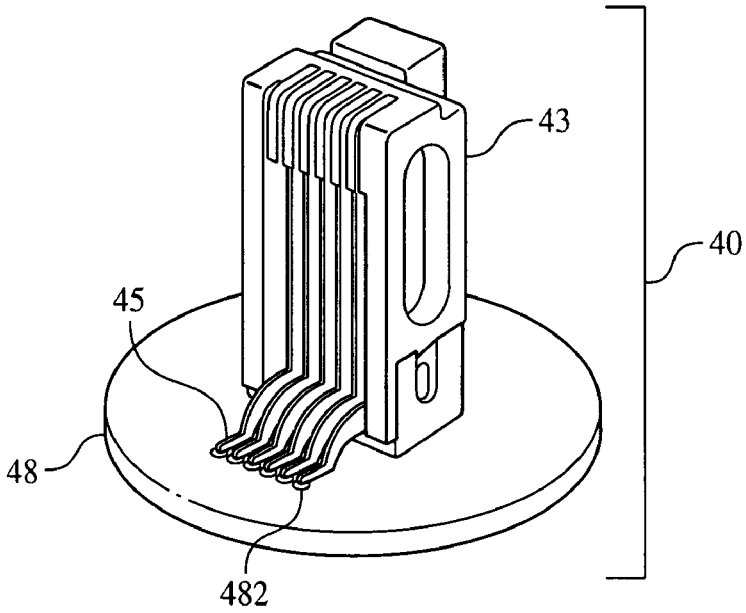
FIG. 4 shows a top perspective view of the assembled male subassembly as shown in FIG. 2.

Printed circuit board 48 may include a plurality of electrically conductive pads 482 disposed on a first surface of printed circuit board 48, facing modular plug 43, as shown in FIG. 4. Electrically conductive pads 482 may comprise a copper, silver, gold, nickel and/or other electrically conductive material. Printed circuit board 48 may further comprise a plurality of concentric circular conductive traces 483 disposed on a second surface of printed circuit board 48, as shown in FIG. 2. Concentric circular conductive traces 483 may comprise a copper, silver, gold, nickel and/or other electrically conductive material. Each of the plurality of concentric circular conductive traces 483 is in electrical communication with a corresponding conductive pad on 482 on an opposite surface of printed circuit board 48 via a conducting path extending through the thickness of printed circuit board 48.

Modular plug 43 is secured to the surface of printed circuit board 48. As shown, modular plug 43 may be secured substantially perpendicularly to the upper surface of printed circuit board 48. An adhesive may be used to secure modular plug 43 to printed circuit board 48. For example, glue may be applied between base portion 46 and printed circuit board 48.

Second terminal end 45 of each of electrically conducting members 42 is in electrical communication with a corresponding conductive pad 482 on a first surface of printed circuit board 48. For example, a second terminal end 45 of each of electrically conducting members 42 may be soldered to an associated conductive pad 482 on printed circuit board 48. Soldering may be completed by hand or wave soldering or any other appropriate process.

Figure 3:
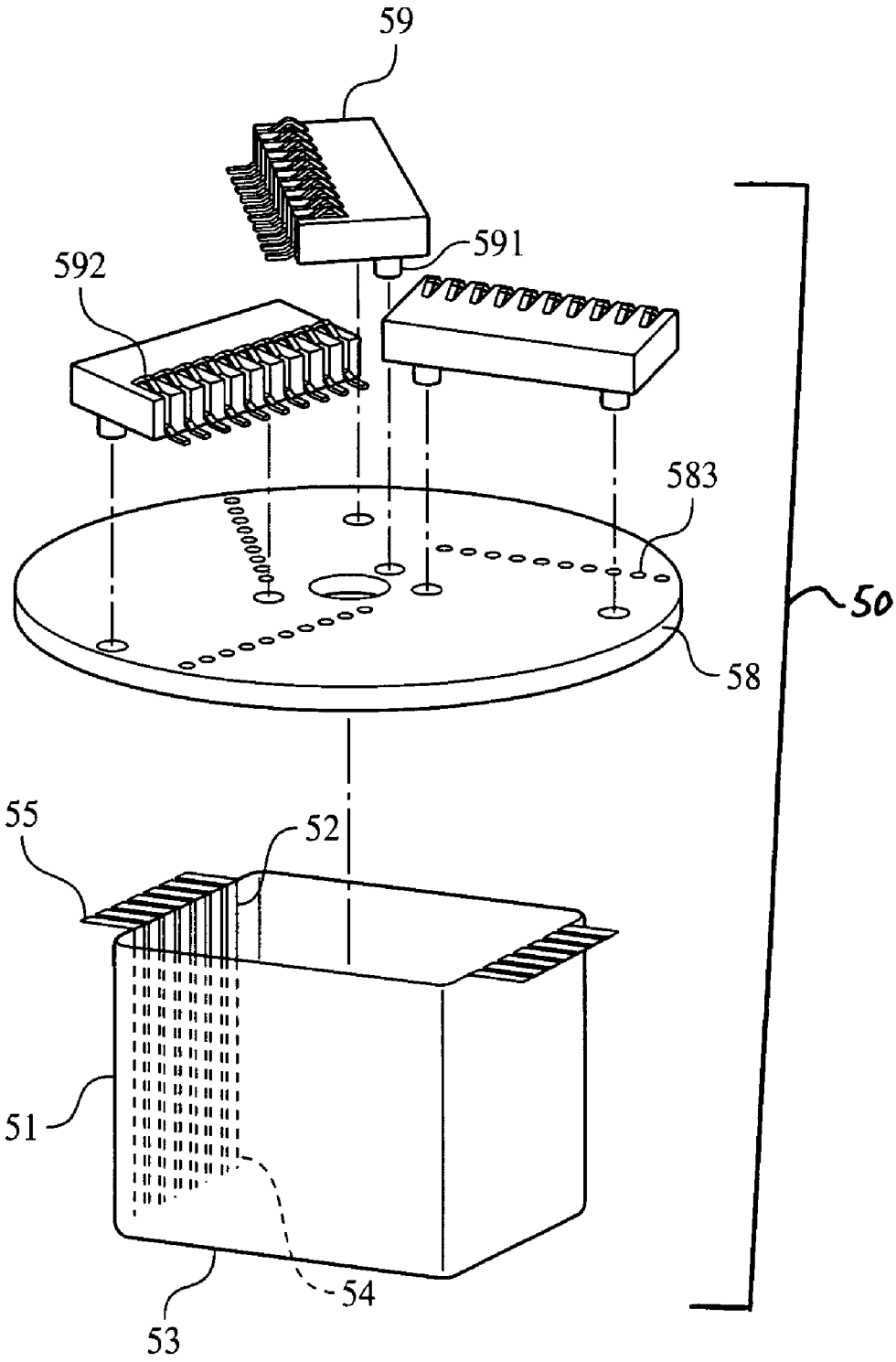
FIG. 3 shows an exploded view of a female subassembly for a rotatable electrical connector according to an embodiment of the invention.
Figure 5:
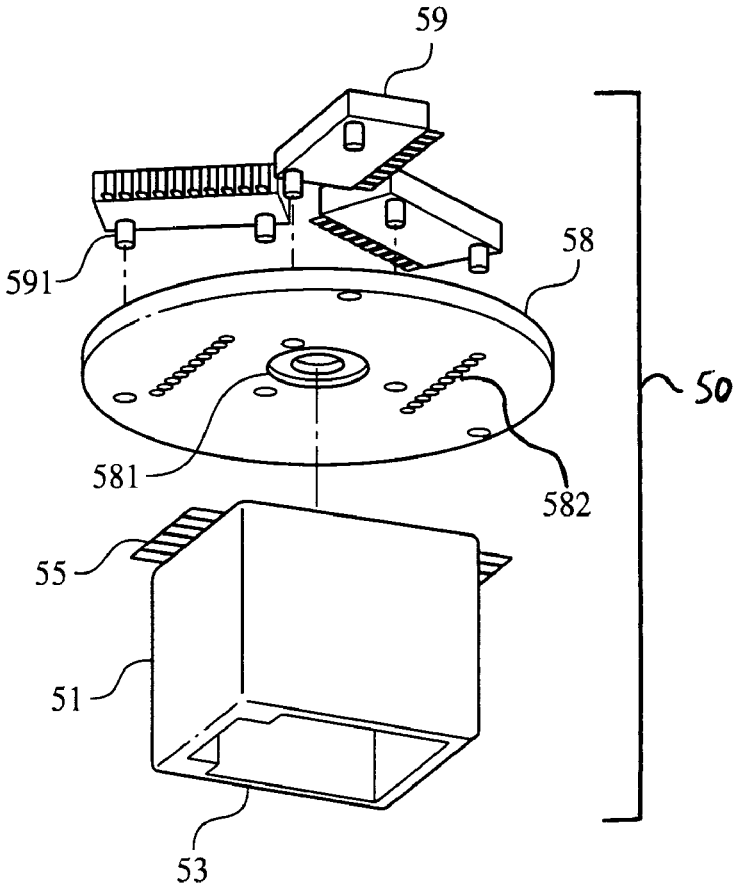
FIG. 5 shows a bottom perspective view of the female subassembly as shown in FIG. 3.

Female subassembly 50 includes a modular jack 51. As shown in FIGS. 3 and 5, the modular jack 51 may comprise a plurality of electrically conducting members 52 which are disposed in an electrically insulating member 53.

Electrically conducting members 52 may be formed from copper or any other suitable electrically conductive material. Electrically insulating member 53 may be formed from a plastic or any other suitable electrically insulating material and may be shaped so as to receive and/or engage a modular male plug 21 on a cable 20.

Each of the electrically conducting members 52 in modular jack 51 may have a first terminal end 54 for contacting an associated conductor element in cable modular male plug 21. Each of the electrically conducting members 52 in modular jack 51 may further have a second terminal end 55.

Female subassembly 50 may further include a printed circuit board 58. Printed circuit board 58 may be circular in shape and may in include a counterbore 581 disposed a substantially central portion thereof. Counterbore 581 may receive and/or engage axle 47. Counterbore 581 may be coated in order to reduce friction between printed circuit board 58 and axle 47 to facilitate the rotation of the male 40 and female 50 subassemblies. For example, at least a portion of counterbore 581 may be plated with a layer of gold, nickel and/or solder mask to reduce friction.

Printed circuit board 58 may be formed by conventional techniques for manufacturing such components and may comprise multiple layers of electrically insulating material provided with traces of electrically conductive material selectively forming an electrically conducting circuit in the printed circuit board.

Printed circuit board 58 may include a first plurality of electrically conductive pads 582 disposed on a first surface of printed circuit board 58, facing modular jack 51, as shown in FIG. 5. Electrically conductive pads 582 may comprise a copper, silver, gold, nickel and/or other electrically conductive material.

Printed circuit board 58 may further comprise a second plurality of electrically conductive pads 583 disposed on a second surface of printed circuit board 58, as shown in FIG. 3. Electrically conductive pads 583 may comprise copper, silver, gold, nickle and/or other electrically conductive material. Each of the first plurality of electrically conductive pads 582 is in electrical communication with a corresponding electrically conductive pad 583 on an opposite surface of printed circuit board 58 via a conducting path extending through the thickness of printed circuit board 58.

Female subassembly 50 may further comprise at least one multi-pin block 59 which is secured to a surface of printed circuit board 58. For example, as shown in FIGS. 3 and 5, three multi-pin blocks may be secured to a surface of printed circuit board 58. Multi-pin block 59 may include one or more locating pins 591 which are inserted into a corresponding aperture in printed circuit board 58 to aid in aligning multi-pin block 59 on printed circuit board 58.

Multi-pin block 59 may include a plurality of resilient electrically conducting elements 592, wherein resilient electrically conducting elements 592 are in electrical communication with corresponding electrically conductive pad 583 on the surface of printed circuit board 58.

Resilient electrically conducting elements 592 may comprise for example, a bottom portion which may be soldered to printed circuit board 58 and a top portion which is bent to form a spring acting element which maintains electrical contact with concentric circular conductive traces 483 on printed circuit board 48, thereby maintaining an electrical connection between the male and female subassemblies.

Modular jack 51 is secured to the surface of printed circuit board 58. As shown, modular jack 51 may be secured substantially perpendicularly to a surface of printed circuit board 58. An adhesive may be used to secure modular jack 51 to printed circuit board 58. For example, glue may be applied between modular jack 51 and printed circuit board 58.

Second terminal end 55 of each of electrically conducting members 52 is in electrical communication with a corresponding conductive pad 582 on the lower surface of printed circuit board 58. For example, a second terminal end 55 of each of electrically conducting members 52 may be soldered to an associated conductive pad 582 on printed circuit board 58. Soldering may be completed by hand or wave soldering or any other appropriate process.

Modular plug 43, modular jack 51 and/or multi pin blocks may comprise through hole components, surface mount components or any other suitable component which may be secured to and electrically coupled to a printed circuit board.

As shown in FIG. 1, assembled male subassembly 40 and female subassembly 50 may be enclosed in a housing 60. Housing 60 may comprise a substantially hollow electrically insulating component having an opening to receive a modular male plug 21. Housing 60 may comprise, for example, a plastic housing formed from a single piece or multiple pieces joined by ultrasonic welding or other appropriate joining procedures.

A retainer 70 may be inserted into housing 60 to retain the assembled male 40 and female 50 subassemblies in place. Retainer 70 may comprise, for example a c-clip. The c-clip may be compressed and inserted into housing 60. The spring clip is then released and engages an undercut groove formed in an inner wall of housing 60, thereby substantially preventing printed circuit board 48 from moving out of housing 60 and retaining the assembled male 40 and female 50 subassemblies within housing 60.

Housing 60 may include an aperture or access hole 610 for inserting an elongated object, for example a pin or a bent paperclip to release the modular male plug 21 of cable 20. The elongated object is inserted into aperture 610 and pressed against a release lever or tab provided on modular male connector 21, thereby releasing the plug from housing 60 and/or modular jack 51.

Figure 6:
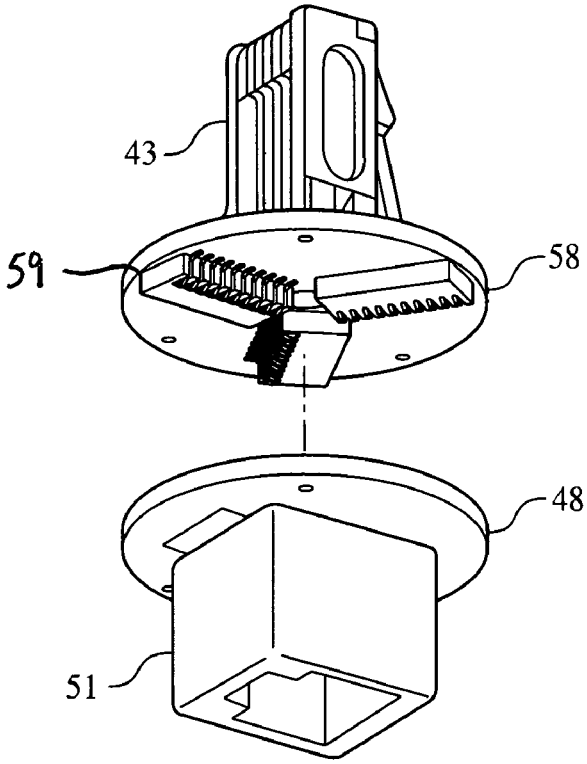
FIG. 6 shows a bottom perspective view of a male and female subassembly for a rotatable electrical connector according to another embodiment of the invention.

A male and female subassembly for a rotatable connector according to another embodiment of the invention are shown in FIG. 6. In this embodiment, a modular plug 43 is secured to secured to a printed circuit board 58, forming a male subassembly. As shown in FIGS. 3 and 5, printed circuit board 58 includes a first plurality of electrically conductive pads on a first surface facing modular plug 43 and a second plurality of electrically conductive pads on an opposite surface. Each of the first plurality of electrically conductive pads is in electrical communication with a corresponding pad from the second plurality of electrically conductive pads.

Electrically conducting members of modular plug 43 are in electrical communication with corresponding pads from the first plurality of electrically conducting pads on first surface of printed circuit board 58.

One or more multi pin blocks 59 are secured to a second surface of printed circuit board 58. As described above, multi-pin block 59 may include a plurality of resilient electrically conducting elements 592, wherein resilient electrically conducting elements 592 are in electrical communication with corresponding electrically conductive pad 583 on the surface of printed circuit board 58 facing multi pin block 59.

Resilient electrically conducting elements 592 may comprise for example, a bottom portion which may be soldered to printed circuit board 58 and a top portion which is bent to form a spring acting element which maintains electrical contact with concentric circular conductive traces 483 on printed circuit board 48, thereby maintaining an electrical connection between the male and female subassemblies.

A female subassembly as shown in FIG. 6, may comprise a modular jack 51 secured to a printed circuit board 48. Printed circuit board 48 may include a plurality of conductive pads on a first side facing modular jack 51 and a plurality of concentric circular traces on a second side facing multi pin blocks 59. Each of the plurality of concentric circular traces is in electrical communication with a corresponding electrically conductive pad on an opposite side of printed circuit board 48, as described above. Electrically conducting members of modular jack 51 are in electrical communication with corresponding electrically conducting pads on the first surface of printed circuit board 48.

Figure 7:
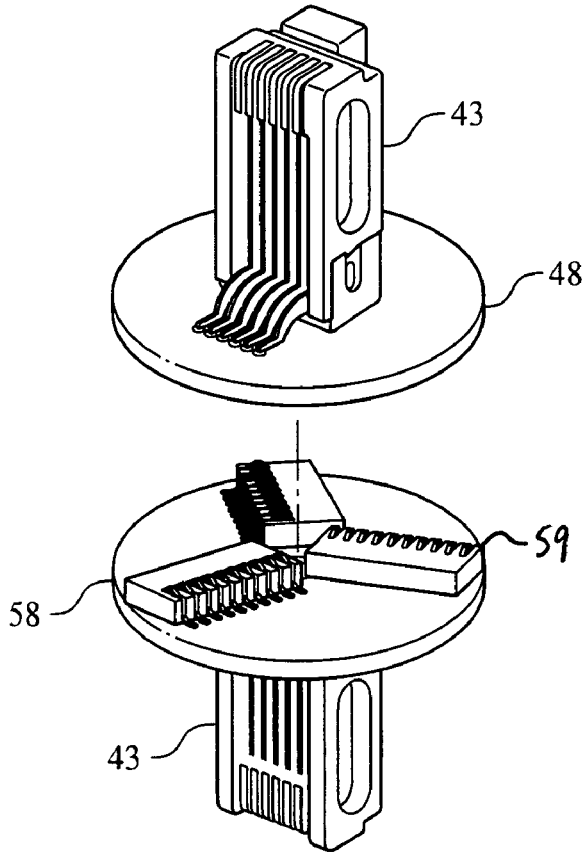
FIG. 7 shows a top perspective view of a first and second subassembly for a rotatable electrical connector according to another embodiment of the invention.
Figure 8:
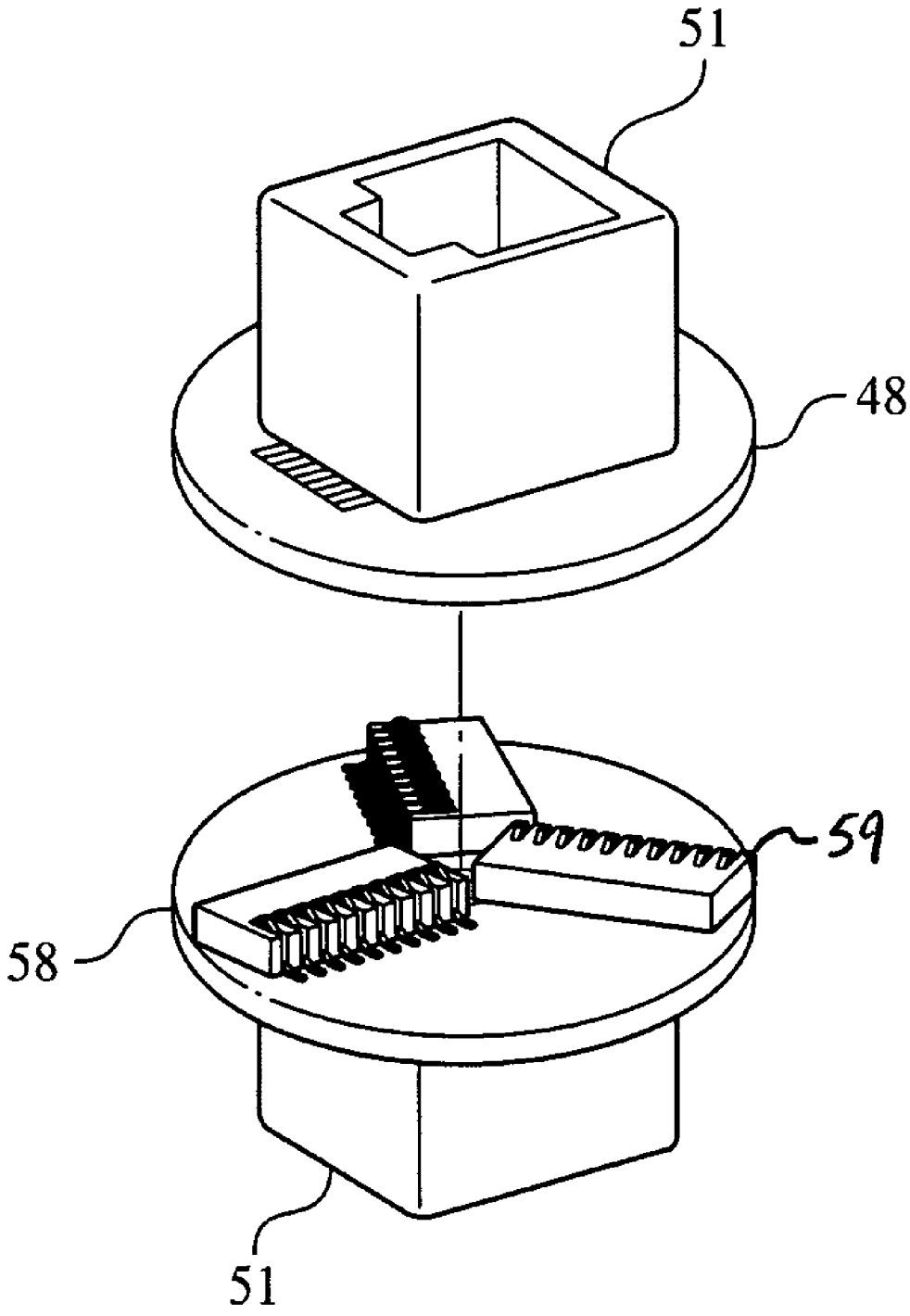
FIG. 8 shows a top perspective view of a first and second subassembly for a rotatable electrical connector according to another embodiment of the invention.

First and second subassemblies for rotatable electrical connectors according to additional embodiments of the invention are shown in FIGS. 7 and 8.

FIG. 7 shows a first and second subassembly for a rotatable electrical connector for providing a connection between a plurality of female jacks. FIG. 8 shows a first and second subassembly for a rotatable electrical connector for providing a connection between a plurality of male plugs.

The embodiments shown in FIGS. 7 and 8 are similar in construction and operation to the embodiments described above, however rather than comprising a modular plug secured to one printed circuit board and a modular jack secured to another printed circuit board, the embodiments of FIGS. 7 and 8 include either modular plugs 43 secured to each of two facing printed circuit boards (FIG. 7) or modular jacks 51 secured to each of two facing printed circuit boards (FIG. 8). It is to be understood that each of the subassemblies illustrated in FIGS. 6, 7 and 8 may be enclosed in a housing and retained by a retainer, as described above with respect to the embodiment shown in FIGS. 1–5.

Accordingly, while several embodiments of the present invention have been shown and described, it is obvious that many changes and modifications may be made thereunto without departing from the spirit and scope of the invention.

What is claimed is:

1. A rotatable electrical connector for providing a tangle free electrical connection between a cable having a modular male plug and a device having a modular female jack, the rotatable electrical connector comprising:

a) a male subassembly comprising:

a modular plug comprising a plurality of electrically conducting members disposed in an electrically insulating member, said plurality of electrically conducting members each having a first terminal end for contacting the modular female jack of the device and a second terminal end; and a first printed circuit board comprising a plurality of conductive pads disposed on a first surface facing said modular plug and a plurality of concentric circular conductive traces disposed on a second surface, each of said plurality of concentric circular conductive traces in electrical communication with a corresponding one of said plurality of conductive pads;

wherein said modular plug is secured to said first surface of said first printed circuit board and said second terminal end of each of said plurality of electrical conducting members is in electrical communication with a corresponding one of said plurality of conductive pads;

b) a female subassembly comprising:

a modular jack comprising a plurality of electrically conducting members disposed in an electrically insulating member, said plurality of electrically conducting members each having a first terminal end for contacting the modular male plug of the cable and a second terminal end;

a second printed circuit board comprising a first plurality of conductive pads disposed on a first surface facing said modular jack and a second plurality of conductive pads disposed on a second surface, each of said first plurality of conductive pads in electrical communication with a corresponding one of said second plurality of conductive pads; and at least one multi-pin block secured to said second surface of said second printed circuit board, said at least one multi-pin block comprising a plurality of resilient electrically conducting elements, wherein each of said plurality of resilient electrically conducting elements is in electrical communication with a corresponding one of said plurality of concentric circular conductive traces of said first printed circuit board and with a corresponding one of said second plurality of conductive pads of said second printed circuit board;

wherein said modular jack is secured to said first surface of said second printed circuit board and said second terminal end of each of said plurality of electrical conducting members is in electrical communication with a corresponding one of said first plurality of conductive pads;

c) an axle extending substantially perpendicularly to said second surface of said first and said second printed circuit board, said axle rotatably connecting said male subassembly and said female subassembly; and d) a housing enclosing said male subassembly and said female subassembly.

2. The rotatable electrical connector according to claim 1, further comprising a retainer for retaining said male subassembly and said female subassembly in said housing.

3. The rotatable electrical connector according to claim 1 wherein said modular plug comprises a surface mount component.

4. The rotatable electrical connector according to claim 1 wherein said modular jack comprises a surface mount component.

5. The rotatable electrical connector according to claim 1 wherein said at least one multi-pin block comprises a surface mount component.

6. The rotatable electrical connector according to claim 1, wherein said housing includes an aperture for inserting an elongated object to release the modular male plug of the cable from the rotatable electrical connector.

7. The rotatable electrical connector according to claim 1, wherein said modular plug is secured substantially perpendicularly to said first surface of said first printed circuit board.

8. The rotatable electrical connector according to claim 1, wherein said modular jack is secured substantially perpendicularly to said first surface of said second printed circuit board.

9. The rotatable electrical connector of claim 1, wherein at least one of said first and said second printed circuit board further comprises a counterbore for receiving said axle.

10. The rotatable electrical connector of claim 9, wherein at least a portion of said counterbore is coated to reduce friction between at least one of said first and said second printed circuit board and said axle.

11. The rotatable electrical connector of claim 9, wherein said counterbore is formed by drilling said at least one of said first and said second printed circuit board.

12. The rotatable electrical connector of claim 9, wherein said counterbore is formed by constructing said at least one of said first and said second printed circuit board from a plurality of layers.

13. The rotatable electrical connector of claim 1, wherein said at least one multi-pin block comprises three multi-pin blocks.

14. A rotatable electrical connector for providing a tangle free electrical connection between a cable having a modular male plug and a device having a modular female jack, the rotatable electrical connector comprising:

a) a female subassembly comprising:

a modular jack comprising a plurality of electrically conducting members disposed in an electrically insulating member, said plurality of electrically conducting members each having a first terminal end for contacting the modular male plug of the cable and a second terminal end;

a first printed circuit board comprising a plurality of conductive pads disposed on a first surface facing said modular jack and a plurality of concentric circular conductive traces disposed on a second surface, each of said plurality of concentric circular conductive traces in electrical communication with a corresponding one of said plurality of conductive pads;

wherein said modular jack is secured to said first surface of said first printed circuit board and said second terminal end of each of said plurality of electrical conducting members is in electrical communication with a corresponding one of said plurality of conductive pads;

b) a male subassembly comprising:

a modular plug comprising a plurality of electrically conducting members disposed in an electrically insulating member, said plurality of electrically conducting members each having a first terminal end for contacting the modular female jack of the device and a second terminal end;

a second printed circuit board comprising a first plurality of conductive pads disposed on a first surface facing said modular plug and a second plurality of conductive pads disposed on a second surface, each of said first plurality of conductive pads in electrical communication with a corresponding one of said second plurality of conductive pads; and at least one multi-pin block secured to said second surface of said second printed circuit board, said at least one multi-pin block comprising a plurality of resilient electrically conducting elements, wherein each of said plurality of resilient electrically conducting elements is in electrical communication with a corresponding one of said plurality of concentric circular conductive traces of said first printed circuit board and with a corresponding one of said second plurality of conductive pads of said second printed circuit board;

wherein said modular plug is secured to said first surface of said second printed circuit board and said second terminal end of each of said plurality of electrical conducting members is in electrical communication with a corresponding one of said first plurality of conductive pads;

c) an axle extending substantially perpendicularly to said second surface of said first and said second printed circuit board, said axle rotatably connecting said male subassembly and said female subassembly; and d) a housing enclosing said male subassembly and said female subassembly.

15. The rotatable electrical connector according to claim 14, further comprising a retainer for retaining said male subassembly and said female subassembly in said housing.

16. The rotatable electrical connector according to claim 14 wherein said modular plug comprises a surface mount component.

17. The rotatable electrical connector according to claim 14 wherein said modular jack comprises a surface mount component.

18. The rotatable electrical connector according to claim 14 wherein said at least one multi-pin block comprises a surface mount component.

19. The rotatable electrical connector according to claim 14, wherein said housing includes an aperture for inserting an elongated object to release the modular male plug of the cable from the rotatable electrical connector.

20. The rotatable electrical connector according to claim 14, wherein said modular jack is secured substantially perpendicularly to said first surface of said first printed circuit board.

21. The rotatable electrical connector according to claim 14, wherein said modular plug is secured substantially perpendicularly to said first surface of said second printed circuit board.

22. The rotatable electrical connector of claim 14, wherein at least one of said first and said second printed circuit board further comprises a counterbore for receiving said axle.

23. The rotatable electrical connector of claim 22, wherein at least a portion of said counterbore is coated to reduce friction between at least one of said first and said second printed circuit board and said axle.

24. The rotatable electrical connector of claim 22, wherein said counterbore is formed by drilling said at least one of said first and said second printed circuit board.

25. The rotatable electrical connector of claim 22, wherein said counterbore is formed by constructing said at least one of said first and said second printed circuit board from a plurality of layers.

26. The rotatable electrical connector of claim 14, wherein said at least one multi-pin block comprises three multi-pin blocks.

27. A rotatable electrical connector for providing a tangle free electrical connection between a plurality of modular female jacks, the rotatable electrical connector comprising:

a) a first subassembly comprising:

a first modular plug comprising a plurality of electrically conducting members disposed in an electrically insulating member, said plurality of electrically conducting members each having a first terminal end for contacting at least one of said plurality modular female jack and a second terminal end; and a first printed circuit board comprising a plurality of conductive pads disposed on a first surface facing said first modular plug and a plurality of concentric circular conductive traces disposed on a second surface, each of said plurality of concentric circular conductive traces in electrical communication with a corresponding one of said plurality of conductive pads;

wherein said first modular plug is secured to said first surface of said first printed circuit board and said second terminal end of each of said plurality of electrical conducting members is in electrical communication with a corresponding one of said plurality of conductive pads;

b) a second subassembly comprising:

a second modular plug comprising a plurality of electrically conducting members disposed in an electrically insulating member, said plurality of electrically conducting members each having a first terminal end for contacting at least one of said plurality of modular female jacks and a second terminal end;

a second printed circuit board comprising a first plurality of conductive pads disposed on a first surface facing said second modular plug and a second plurality of conductive pads disposed on a second surface, each of said first plurality of conductive pads in electrical communication with a corresponding one of said second plurality of conductive pads; and at least one multi-pin block secured to said second surface of said second printed circuit board, said at least one multi-pin block comprising a plurality of resilient electrically conducting elements, wherein each of said plurality of resilient electrically conducting elements is in electrical communication with a corresponding one of said plurality of concentric circular conductive traces of said first printed circuit board and with a corresponding one of said second plurality of conductive pads of said second printed circuit board;

wherein said second modular plug is secured to said first surface of said second printed circuit board and said second terminal end of each of said plurality of electrical conducting members is in electrical communication with a corresponding one of said first plurality of conductive pads;

c) an axle extending substantially perpendicularly to said second surface of said first and said second printed circuit board, said axle rotatably connecting said first subassembly and said second subassembly; and d) a housing enclosing said first subassembly and said second subassembly.

28. The rotatable electrical connector according to claim 27, wherein said housing includes at least one aperture for inserting an elongated object for releasing at least one of said first modular plug and said second modular plug from at least one of said plurality of modular female jacks.

29. The rotatable electrical connector according to claim 27, further comprising a retainer for retaining said first subassembly and said second subassembly in said housing.

30. The rotatable electrical connector according to claim 27 wherein at least one of said first modular plug and said second modular plug comprises a surface mount component.

31. The rotatable electrical connector according to claim 27, wherein said at least one multi-pin block comprises a surface mount component.

32. The rotatable electrical connector according to claim 27, wherein said first modular plug is secured substantially perpendicularly to said first surface of said first printed circuit board.

33. The rotatable electrical connector according to claim 27, wherein said second modular plug is secured substantially perpendicularly to said first surface of said second printed circuit board.

34. The rotatable electrical connector of claim 27, wherein at least one of said first and said second printed circuit board further comprises a counterbore for receiving said axle.

35. The rotatable electrical connector of claim 34, wherein at least a portion of said counterbore is coated to reduce friction between at least one of said first and said second printed circuit board and said axle.

36. The rotatable electrical connector of claim 34, wherein said counterbore is formed by drilling said at least one of said first and said second printed circuit board.

37. The rotatable electrical connector of claim 34, wherein said counterbore is formed by constructing said at least one of said first and said second printed circuit board from a plurality of layers.

38. The rotatable electrical connector of claim 27, wherein said at least one multi-pin block comprises three multi-pin blocks.

39. A rotatable electrical connector for providing a tangle free electrical connection between a plurality of modular male plugs, the rotatable electrical connector comprising:

a) a first subassembly comprising:

a first modular jack comprising a plurality of electrically conducting members disposed in an electrically insulating member, said plurality of electrically conducting members each having a first terminal end for contacting at least one of said plurality modular male plugs and a second terminal end; and a first printed circuit board comprising a plurality of conductive pads disposed on a first surface facing said first modular jack a plurality of concentric circular conductive traces disposed on a second surface, each of said plurality of concentric circular conductive traces in electrical communication with a corresponding one of said plurality of conductive pads;

wherein said first modular jack is secured to said first surface of said first printed circuit board and said second terminal end of each of said plurality of electrical conducting members is in electrical communication with a corresponding one of said plurality of conductive pads;

b) a second subassembly comprising:

a second modular jack comprising a plurality of electrically conducting members disposed in an electrically insulating member, said plurality of electrically conducting members each having a first terminal end for contacting at least one of said plurality of modular male plugs and a second terminal end;

a second printed circuit board comprising a first plurality of conductive pads disposed on a first surface facing said second modular jack and a second plurality of conductive pads disposed on a second surface, each of said first plurality of conductive pads in electrical communication with a corresponding one of said second plurality of conductive pads; and at least one multi-pin block secured to said second surface of said second printed circuit board, said at least one multi-pin block comprising a plurality of resilient electrically conducting elements, wherein each of said plurality of resilient electrically conducting elements is in electrical communication with a corresponding one of said plurality of concentric circular conductive traces of said first printed circuit board and with a corresponding one of said second plurality of conductive pads of said second printed circuit board;

wherein said second modular jack is secured to said first surface of said second printed circuit board and said second terminal end of each of said plurality of electrical conducting members is in electrical communication with a corresponding one of said first plurality of conductive pads;

c) an axle extending substantially perpendicularly to said second surface of said first and said second printed circuit board, said axle rotatably connecting said first subassembly and said second subassembly; and d) a housing enclosing said first subassembly and said second subassembly.

40. The rotatable electrical connector according to claim 39, further comprising a retainer for retaining said first subassembly and said second subassembly in said housing.

41. The rotatable electrical connector according to claim 39, wherein at least one of said first modular jack and said second modular jack comprises a surface mount component.

42. The rotatable electrical connector according to claim 39, wherein said at least one multi-pin block comprises a surface mount component.

43. The rotatable electrical connector according to claim 39, wherein said housing includes at least one aperture for inserting an elongated object to release at least one of the plurality of modular male plugs from the rotatable electrical connector.

44. The rotatable electrical connector according to claim 39, wherein said first modular jack is secured substantially perpendicularly to said first surface of said first printed circuit board.

45. The rotatable electrical connector according to claim 39, wherein said second modular jack is secured substantially perpendicularly to said first surface of said second printed circuit board.

46. The rotatable electrical connector of claim 39 wherein at least one of said first and said second printed circuit board further comprises a counterbore for receiving said axle.

47. The rotatable electrical connector of claim 46, wherein at least a portion of said counterbore is coated to reduce friction between at least one of said first and said second printed circuit board and said axle.

48. The rotatable electrical connector of claim 46 wherein said counterbore is formed by drilling said at least one of said first and said second printed circuit board.

49. The rotatable electrical connector of claim 46, wherein said counterbore is formed by constructing said at least one of said first and said second printed circuit board from a plurality of layers.

50. The rotatable electrical connector of claim 39, wherein said at least one multi-pin block comprises three multi-pin blocks.

* * * * *